US007452421B2

(12) United States Patent
Thome et al.

(10) Patent No.: US 7,452,421 B2
(45) Date of Patent: Nov. 18, 2008

(54) SPRAYING BOWL, ROTARY SPRAYER INCORPORATING SUCH A BOWL AND SPRAYING INSTALLATION INCORPORATING SUCH A SPRAYER

(75) Inventors: Caryl Thome, Saint Egreve (FR); Patrick Ballu, Reims (FR); Eric Prus, Grenoble (FR); Laurent Giraud, Lumbin (FR)

(73) Assignee: Sames Technologies, Meylan (FR)

( * ) Notice: Subject to any disclaimer, the term of this patent is extended or adjusted under 35 U.S.C. 154(b) by 226 days.

(21) Appl. No.: 11/049,945

(22) Filed: Feb. 4, 2005

(65) Prior Publication Data

US 2005/0172892 A1 Aug. 11, 2005

Related U.S. Application Data

(60) Provisional application No. 60/541,909, filed on Feb. 6, 2004.

(30) Foreign Application Priority Data

Apr. 2, 2004 (FR) ..... 04 03506

(51) Int. Cl.
*B05B 3/00* (2006.01)
*B05B 3/10* (2006.01)

(52) U.S. Cl. ..... 118/323; 118/321; 239/223; 239/224; 239/DIG. 11

(58) Field of Classification Search ..... 118/300, 118/323, 321; 239/220, 223, 224, 381, 394, 239/DIG. 11

See application file for complete search history.

(56) References Cited

U.S. PATENT DOCUMENTS

| | | | | |
|---|---|---|---|---|
| 4,473,188 | A | 9/1984 | Ballu | |
| 5,584,435 | A * | 12/1996 | Lind | 239/73 |
| 5,685,495 | A | 11/1997 | Pham et al. | |
| 5,697,559 | A * | 12/1997 | Davis et al. | 239/703 |
| 6,592,054 | B2 * | 7/2003 | Prus | 239/224 |
| 2001/0015386 | A1 | 8/2001 | Pruss | |
| 2004/0140378 | A1 | 7/2004 | Merabet | |

FOREIGN PATENT DOCUMENTS

| | | | |
|---|---|---|---|
| JP | 2000 135453 | A | 5/2000 |
| WO | WO 94/12286 | A1 | 6/1994 |
| WO | WO 01/62396 | A1 | 8/2001 |
| WO | WO 2004/024338 | A2 | 3/2004 |

* cited by examiner

*Primary Examiner*—Yewebdar T Tadesse
(74) *Attorney, Agent, or Firm*—Browdy and Neimark, P.L.L.C.

(57) ABSTRACT

The bowl according to the invention is equipped with first magnetic coupling means adapted to cooperate with second complementary magnetic coupling means fixed on a non-rotary part of a sprayer, these first and second coupling means being adapted to exert an at least partially axial effort inducing the coupling in rotation of the bowl with a corresponding drive member. The radial width of an annular or truncated surface defined by the first coupling means is greater than the total radial width of the coupling means borne by the non-rotary part.

19 Claims, 5 Drawing Sheets

SPRAYING BOWL, ROTARY SPRAYER INCORPORATING SUCH A BOWL AND SPRAYING INSTALLATION INCORPORATING SUCH A SPRAYER

The present application claims the benefit of U.S. Provisional Appln. No. 60/541,909, filed Feb. 6, 2004

FIELD OF THE INVENTION

The present invention relates to a spraying bowl for a rotary sprayer spraying coating product. The invention also relates to a coating product sprayer comprising such a bowl, as well as to an installation for spraying coating product incorporating such a sprayer.

BACKGROUND OF THE INVENTION

In a coating product spraying installation, it is known to spray the product by means of a rotary element, called a bowl or dish, supplied with product and rotating at a speed usually included between 2,000 and 120,000 rpm. At the speeds in question, the bowl must be as light and balanced as possible in order to avoid unbalance to a maximum, particularly if its means for driving in rotation comprise an air and/or magnetic bearing turbine.

It is known, for example from WO-A-94/12286, to connect a bowl to a rotor by means of a fitting ring capable of radial expansion. It is also known, for example from WO-A-01/62396, to use magnetic coupling means between a bowl and the rotor of a turbine. These coupling means comprise permanent magnets which are relatively complex to assemble on the bowl or on the rotor of the turbine, particularly in order to avoid these magnets bursting under the effect of the centrifugal force. Such assembly most often prevents a rapid replacement of the magnetic coupling magnets. In addition, the balance of the rotating parts must be as perfect as possible in order to limit the effect of the forces of inertia. The or each magnet used must therefore be balanced in rotation, which is delicate to effect, as the material constituting the magnet or magnets does not have an isotropic density and because such a material is brittle, therefore difficult to machine.

It is a particular object of the invention to overcome these drawbacks by proposing a spraying bowl which may be easily driven by a rotor provided to that end thanks to an efficient magnetic coupling, without requiring the assembly of permanent magnets on a rotating part of the sprayer.

SUMMARY OF THE INVENTION

In that spirit, the invention relates to a spraying bowl for a rotary sprayer spraying coating product, which is characterized in that it is equipped with first magnetic coupling means adapted to cooperate with second complementary magnetic coupling means fixed on a non-rotary part of the sprayer, these first and second coupling means being adapted to exert an at least partially axial effort with respect to the axis of rotation of this bowl, this effort inducing the coupling in rotation of the bowl with a corresponding drive member.

Thanks to the invention, the effort resulting from the magnetic coupling makes it possible to connect the bowl and its drive means, particularly the rotor of a turbine, even if the magnetic coupling occurs between the bowl, which is rotary, and a non-rotary part of the sprayer. It may therefore be provided to mount the or each coupling magnet on this non-rotary part, said magnet(s) in that case not having to be balanced.

According to advantageous but non-obligatory aspects, a spraying bowl may incorporate one or more of the following characteristics:

- The coupling means borne by the bowl are disposed so that the effort of coupling is essentially axial.
- A male part, whose external shape is globally truncated, is adapted to be engaged in a central housing of corresponding shape made in the member for drive in rotation, the bowl being able to be connected in rotation with this member by adherence between the aforementioned male part and housing, by reason of the axial effort due to the coupling means. In a variant, the bowl defines a globally truncated housing, while a male part of corresponding shape, fast with the drive member, is provided to be engaged in this housing and allows a connection in rotation of the bowl and the drive member by adherence, due to the aforementioned axial effort.
- The first magnetic coupling means define an annular or truncated surface which delimits an air gap between the magnetic coupling means, while the radial width of this surface is greater than the total radial width of the second coupling means. Thanks to this aspect of the invention, the magnetic coupling effort in the air gap remains substantially axial, including in the case of radial offset between the coupling means, this avoiding the magnetic coupling effort exerting on the bowl an unbalanced effort which might lead to a contact between a rotary part and a non-rotary part of the sprayer.
- The first magnetic coupling means are formed by an annular element made of magnetic material fitted or screwed around the principal body of the bowl and defining an annular or truncated surface defining the air gap with the second coupling means.

The invention also relates to a rotary sprayer spraying coating product, which comprises a bowl and a member for driving this bowl in rotation, this sprayer being characterized in that it also comprises means for magnetic coupling between the bowl and a non-rotary part of the sprayer, these means being adapted to exert an at least partially axial effort with respect to the axis of rotation of the bowl, this effort inducing the coupling of the aforementioned bowl and member in rotation.

According to advantageous but non-obligatory aspects, such a sprayer may incorporate more or more of the following characteristics, taken in any technically admissible combination:

- The coupling means are disposed so that the coupling effort obtained is essentially axial.
- The aforementioned bowl and member are respectively provided with parts, of complementary shapes, for coupling in rotation by adherence.
- The magnetic coupling means comprise at least one magnet disposed in annular manner about the axis of rotation of the bowl and fixed on the non-rotary part, while the coupling means borne by the bowl define an annular or truncated surface delimiting an air gap between the coupling means borne by the bowl and this magnet and the radial width of this surface is greater than the radial width of this magnet. Thanks to this aspect of the invention and, in particular, when the aforementioned surface is annular, the magnetic coupling effort remains substantially axial, including in the case of radial offset of the annular interaction surface with respect to the magnet. In that case, the mean radius of this surface may be provided to be substantially equal to the mean radius of this magnet, and/or the magnet provided to be radially bordered, internally and externally, by two volumes of material which is amagnetic or with low magnetic permeability, while the radial width of the aforementioned surface is greater than the radial width of the magnet increased by the radial width of these volumes. These volumes of material which is amagnetic or with low magnetic permeability may be formed by air, annular rings made of aluminium based alloy or filled with glue for fixation of the or each magnet in a receiving volume fast with the non-rotary part of the sprayer. The radial widths of each of these volumes are advantageously greater than the air gap defined between the aforementioned surface and the magnet, preferably at least three times greater than this air gap, and preferably still of the order of five times this air gap. In addition, the aforementioned surface may be provided to project radially, inwardly and outwardly, with respect to the magnet and to the volumes of amagnetic material, by an overhang at least greater than the air gap between this surface and this magnet, preferably at least three times greater than this air gap, and preferably still of the order of five times this air gap.

A part of the magnetic coupling means is integrated in an annular support added on the body of the sprayer and extending it axially. This aspect of the invention makes it possible to equip an existing turbine with the annular support in question, and this in order to allow an existing sprayer to be upgraded into a sprayer according to the invention.

The air gap between those parts of the magnetic coupling means respectively fast with the bowl and the-non-rotary part is such that this axial effort has an intensity included between 5 and 20 daN.

The bowl and/or the drive member is provided with a clearance for assembly/dismantling, this avoiding a wedging of the bowl on the drive member in the event of the presence of soiling at the interface between these elements.

An air flow is provided in the air gap between the magnetic coupling means, this avoiding the accumulation of soiling in this air gap, such soiling being due to the arrival of solid or liquid particles coming from the cloud of product sprayed by the bowl.

Finally, the invention relates to an installation for spraying coating product, which comprises at least one sprayer as described hereinbefore. Such an installation is easier to operate and maintain than those of the state of the art, particularly insofar as assembly of the bowls on the turbines, and dismantling thereof, is facilitated.

BRIEF DESCRIPTION OF THE DRAWINGS

The invention will be more readily understood on reading the following description of two forms of embodiment of a sprayer according to the invention comprising a bowl according to the invention, given solely by way of example and made with reference to the accompanying drawings, in which.

DESCRIPTION OF PREFERRED EMBODIMENTS

Figure 1:
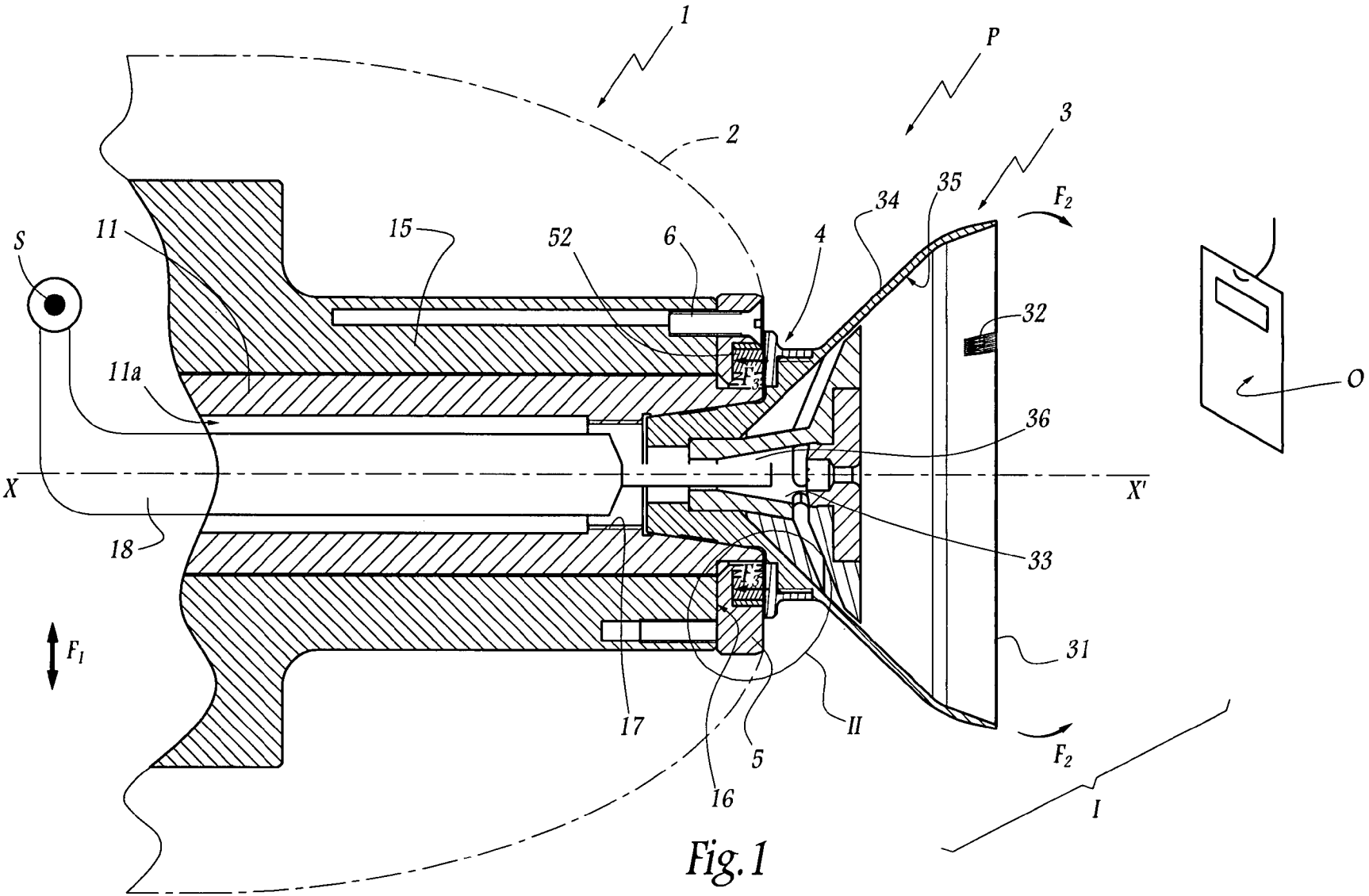
FIG. 1 is a longitudinal section of a coating product sprayer in accordance with a first form of embodiment of the invention, incorporating a bowl according to the invention and forming part of an installation according to the invention.

Referring now to the drawings, the sprayer P shown in FIGS. 1 to 4 is intended to be supplied with coating product from one or more sources S and displaced, for example, with an essentially vertical movement represented by double arrow $F_1$, opposite objects O to be coated inside an installation I for coating these objects. The sprayer P comprises an air turbine of which only the front end 1 has been shown, i.e. the part oriented towards the objects O to be coated. This end 1 is surrounded by a protective cover 2 and supports a bowl 3 intended to be rotated about an axis X-X' by the rotor 11 of the turbine.

The rotor 11 makes it possible to drive the bowl 3 at a speed of several tens of thousands of revs per minute, for example 80,000 rpm, with the result that the coating product coming from the source S through an injection tube 18 is sprayed in the direction of an object O, as represented by arrows $F_2$.

According to an advantageous aspect of the invention which has not been shown, the sprayer P may be of electrostatic type, i.e. comprise means for electrostatically charging the coating product before or after the latter has been discharged from the edge 31 of the bowl 3. As shown partially in the Figures, the bowl 3 may be provided with a notch 32.

The bowl 3 comprises a two-part hub 33 as well as a body 34 forming dish and defining a surface 35 for flow and distribution of the coating product in the direction of the edge 31. The hub 33 is hollow and defines a longitudinal channel 36 which is centred on an axis $X_3$-$X'_3$ merged with axis X-X' when the bowl 3 is mounted on the rotor 11. The axis $X_3$-$X'_3$ is an axis of symmetry of the body 34 which is, for example, made of titanium.

A ring 4 made of ferromagnetic material, for example magnetic stainless steel, is mounted around the body 34. The ring 4 is in one piece and comprises an annular skirt 41 provided with an inner tapping allowing the fixation of the ring 4 by screwing on an external thread 37 of the body 34. In a variant, the ring 4 may be fitted by force around the bowl 3. According to another variant, the ring 4 may be in one piece with the body 34.

The ring 4 comprises a part 42 globally perpendicular to the skirt 41 and which defines an annular surface $S_{42}$ perpendicular to axis $X_3$-$X'_3$. $l_{42}$ denotes the radial width of the surface $S_{42}$, this width being measured in a radial direction with respect to axis $X_3$-$X'_3$.

The body 34 forms a male part 38 intended to penetrate in a central housing 12 of the rotor 11. The external surface 38*a* of the part 38 is globally truncated and convergent towards the rear of the bowl 3, i.e. opposite the edge 31. The surface 12*a* of the housing 12 is also truncated and divergent in the direction of the front face 13 of the rotor 11. $\alpha$ denotes the semi-vertex angle of part 38 and $\beta$ the semi-vertex angle of the housing 12. The angles $\alpha$ and $\beta$ are substantially equal, this allowing a surface abutment of the surfaces 38*a* and 12*a*. Such a surface abutment allows a connection of the elements 11 and 3 in rotation by adherence.

According to a variant of the invention (not shown), the bowl may be provided with a globally truncated housing similar to housing 12, while the rotor is equipped with a likewise truncated male part similar to part 38, these elements in relief also allowing a connection of the elements 11 and 3 by adherence.

In order to avoid a wedging of the part 38 in the housing 12, a first clearance 38*b* is formed at the junction of the surface 38*a* and of a surface 34*b* for connecting the body 34 to the surface $S_{42}$. A second clearance 12*b* is provided in the bottom of the housing 12 in the form of a radial groove. The clearances 38*b* and 12*b* are intended to be disposed, when the bowl 3 is mounted on the rotor 11, respectively opposite an entrance bevel 12*c* of the housing 12 and the end edge 38*c* of the part 38. These clearances avoid soiling wedging the part 38 in the housing 12.

A body 15 of the turbine surrounds the rotor 11 and, in practice, constitutes the stator of the turbine. This body 15 is not mobile in rotation. A support 5 made of magnetic material, for example magnetic stainless steel, is mounted on the front face 16 of the body 15, this support being provided with an annular groove 51 centred on axis X-X' and in which a likewise annular magnet 52 is disposed. The magnet 52 is maintained in place in the groove 51 by two layers of glue 53 and 54 which extend radially on either side of the magnet 52. The layers of glue 53 and 54 thus form two substantially annular washers disposed on either side of the magnet 52. Taking into account the nature of the glue, which may be glue based on epoxy resin, these washers are amagnetic.

In place of one sole magnet 52, a plurality of magnets may be disposed in the groove 51, jointly forming a ring. The or each magnet may be made of ferromagnetic metal or of synthetic resin laden with particles of ferromagnetic metal injected so that these particles are oriented in the same overall direction.

In place of the layers 53 and 54 of glue, washers of metal which is amagnetic or with low magnetic permeability, particularly aluminium, may be used. Similarly, volumes filled with air may suit, as long as the magnet is fixed in the groove 51 by another means.

$l_{52}$ denotes the radial width of the magnet 52.

$l_{52}$ and $l_{54}$ denote the radial widths or the respective thicknesses of the layers or washers 53 and 54.

$R_{52}$ denotes the mean radius of the magnet 52. $R_{42}$ denotes the mean radius of the surface 42. Radii $R_{42}$ and $R_{52}$ are substantially equal, this corresponding to the fact that, when the bowl 3 is mounted on the rotor 11, the surface $S_{42}$ is disposed opposite the exposed surface $S_{52}$ of the magnet 52 and centred thereon. The magnetic field due to the magnet 52 therefore recloses through the part 42 of the ring 4, as is apparent from the representation of its field lines L in FIG. 2.

This magnetic field makes it possible to exert on the ring 4 an effort $F_3$ parallel to axis X-X', i.e. axial, and tending to apply the bowl 3 firmly on the rotor 11, i.e. the surface 38*a* on the surface 12*a*. Taking this effort into account, the surfaces 38*a* and 12*a* in contact are connected in rotation, this allowing the bowl 3 to be driven by the rotor 11.

Figures 2, 2A:
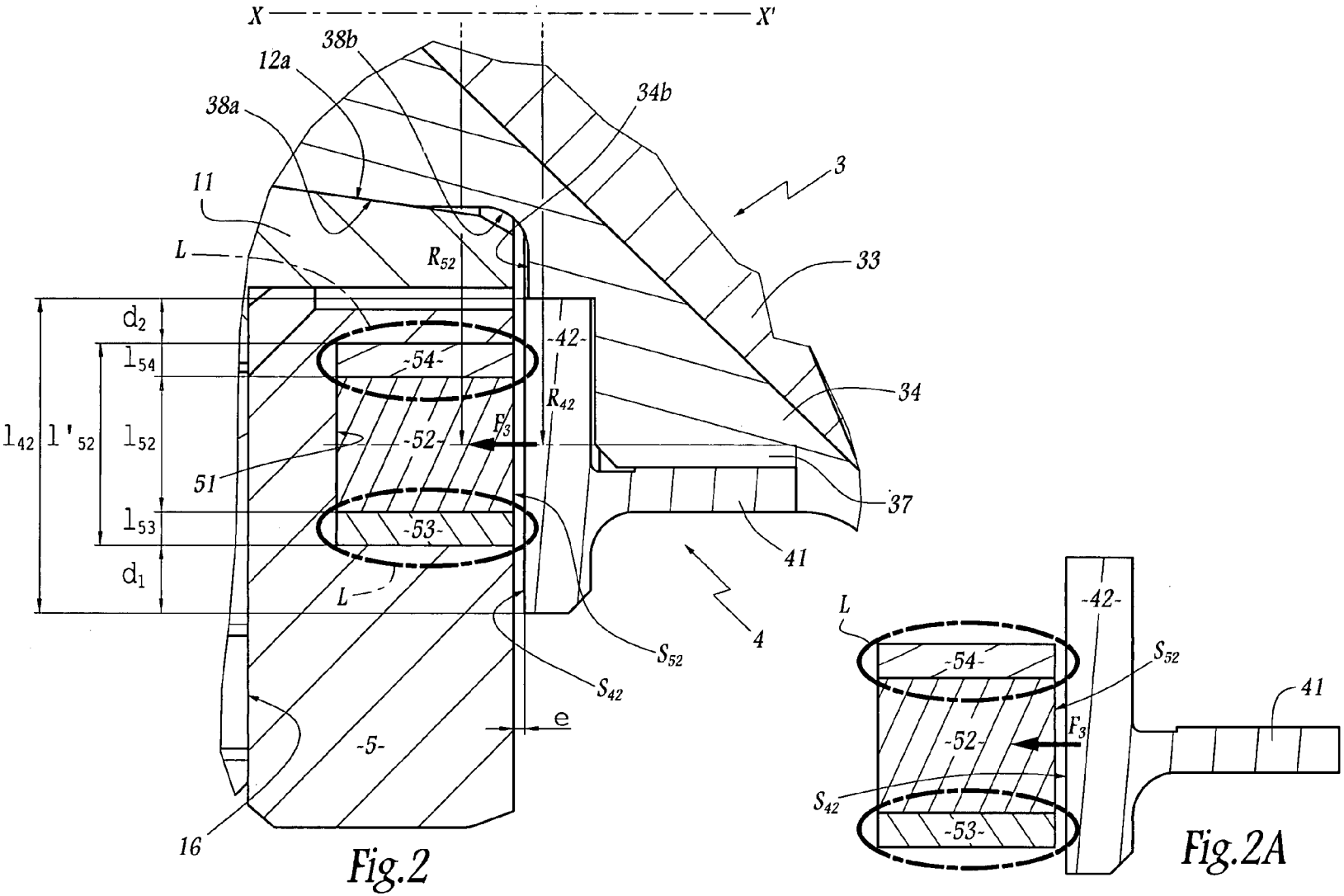
FIG. 2 is a view on a larger scale of detail II in FIG. 1.
FIG. 2A is similar to FIG. 2 but shows only the magnetic coupling elements in an offset configuration, the offset being exaggerated in order to render the drawing clearer.
Figure 3:
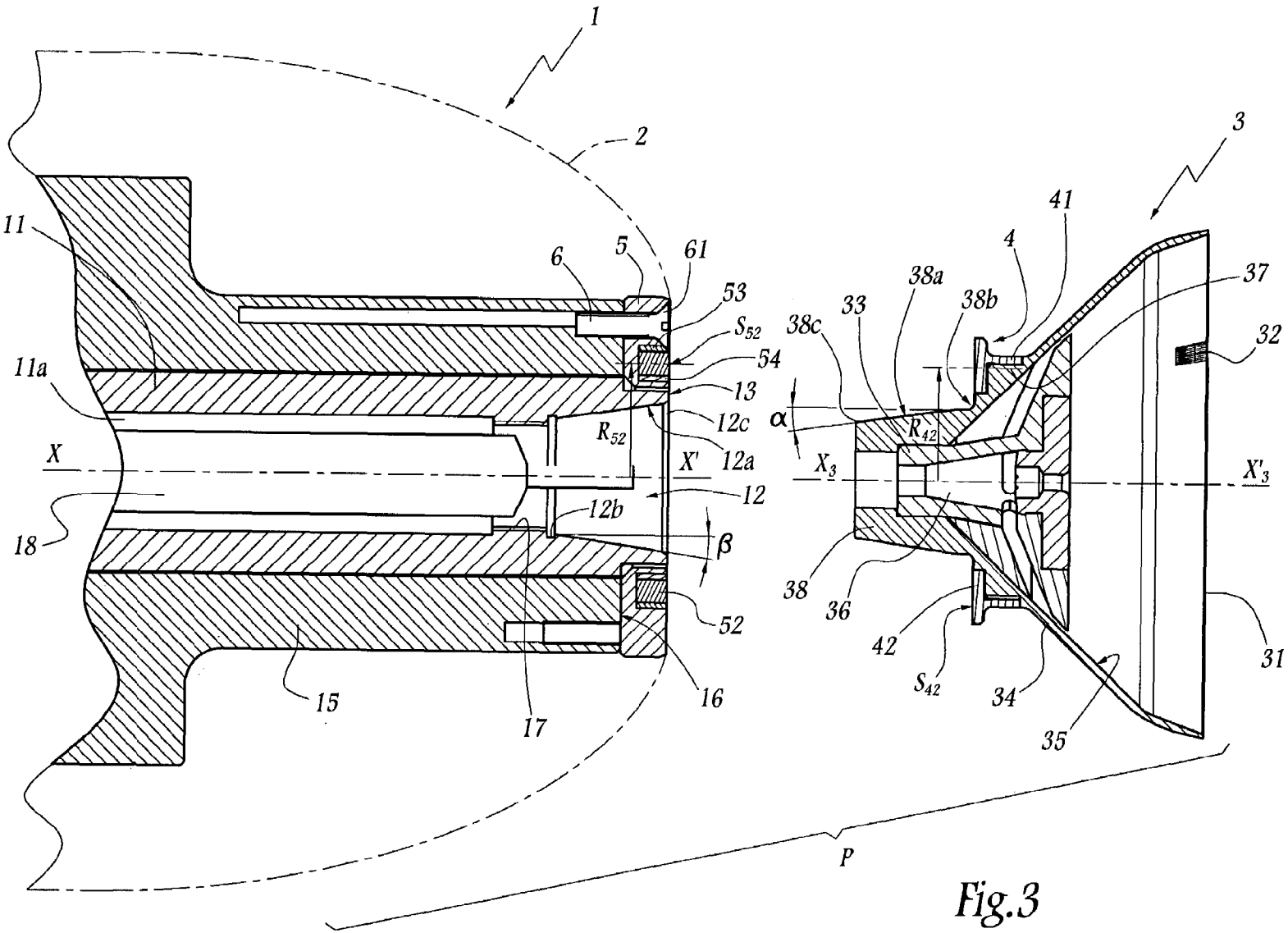
FIG. 3 is a section similar to FIG. 1, the bowl being offset with respect to the body of the sprayer.
Figure 4:
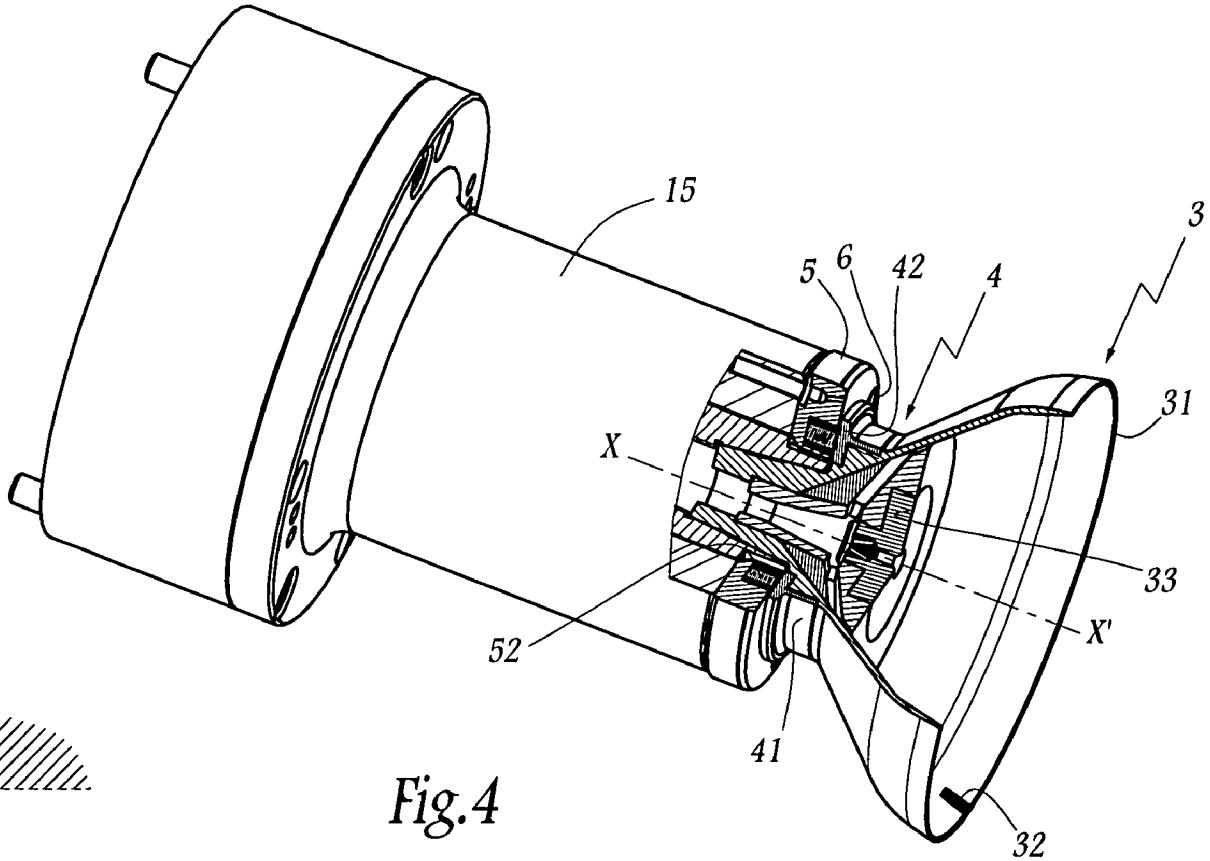
FIG. 4 is a view in perspective with parts torn away of the sprayer of FIGS. 1 to 3.

It will be noted that the effort $F_3$ is parallel to axis X-X' in the plane of FIG. 2, as in any plane of section containing the axis X-X', this resulting from the fact that the surfaces $S_{42}$ and $S_{52}$ are perpendicular to axis X-X'.

As the width $l_{42}$ is greater than width $l_{52}$ and, in practice, greater than the sum $l'_{52}$ of the width $l_{52}$ and of the widths $l_{53}$ and $l_{54}$, the magnetic field due to the bias of the magnet 52 recloses through the part 42 of the ring 4 even if the latter is slightly offset radially with respect to the magnet 52, as shown in FIG. 2A. This Figure corresponds to the case of the axis $X_3$-$X'_3$ of the bowl 3 not being aligned with axis X-X' of the rotor 11 when the bowl is placed in position on the rotor. In that case, the effort $F_3$ remains substantially axial, which does not risk provoking a displacement of the bowl 3 with respect to the rotor 11 in a radial direction, such a displacement being able to lead to damage of the zones 12 and 38 in contact between these parts or to a transverse displacement of the rotor 11 capable of damaging its own drive means, for example its fins in the case of an air turbine.

As long as the width $l_{42}$ has a sufficiently high value with respect to widths $l_{52}$, $l_{53}$ and $l_{54}$, the radii $R_{42}$ and $R_{52}$ are not necessarily equal.

e denotes the value of the air gap made between the surfaces $S_{52}$ and $S_{42}$. $d_1$ denotes the distance over which the surface $S_{42}$ projects radially towards the outside with respect to the layer 53. $d_2$ denotes the distance over which the surface $S_{42}$ projects radially towards the inside with respect to the layer 54. Overhangs $d_1$ and $d_2$ are different. However, they may be equal. Each of the overhangs $d_1$ and $d_2$ is greater than the value of the air gap e. In practice, these overhangs are at least three times greater than this air gap and, preferably, of the order of five times this air gap, this giving good stability of the effort $F_3$, including in the event of slight radial displacement of the bowl 3 with respect to the rotor 11.

Furthermore, the thicknesses $l_{53}$ and $l_{54}$ are greater than the air gap e, preferably at least three times greater than this air gap. In practice, a choice of the thicknesses $l_{53}$ and $l_{54}$ substantially equal to five times this air gap allows a good distribution of the field lines.

The support 5 is immobilized on the front face 16 of the body 15 by means of three screws 6 whose milled head 61 bears on the layer 53 and possibly on the magnet 52, this contributing to immobilizing the coupling means 52 to 54 in the groove 51. The support 5 axially extends the body 15 towards the front, i.e. in the direction of objects O.

The fact that the magnets 52 and 54 are integrated in the support 5 makes it possible to provide adding such a support on the body 15 of a conventional turbine in which a bowl is normally immobilized on the rotor 11 by screwing thanks to a tapping 17 provided in the central bore 11*a* of the rotor 11 in which the tube 18 is disposed. In this way, the fact of mounting the support 5 on a turbine makes it possible to convert a conventional sprayer, in which a bowl is screwed on the rotor, into a sprayer according to the invention. This aspect of the invention makes it possible to envisage upgrading the existing equipment.

According to a variant of the invention (not shown), the magnetic coupling means 52, 53 and 54 may be integrated on the body 15 directly, without using an added support.

Figure 5:
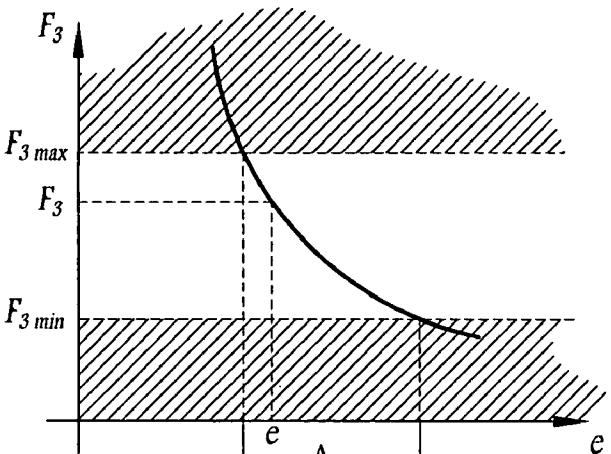
FIG. 5 schematically shows the variation of the effort of magnetic coupling as a function of the air gap.

As is more particularly visible in FIG. 5, the effort $F_3$ is substantially inversely proportional to the value of the square of the air gap e. The air gap e is chosen so that the effort $F_3$ is greater than a minimum value $F_{3min}$ of the order of 5 daN corresponding to a satisfactory hold of the bowl 3 on the rotor 11. The air gap e is also chosen so that the effort $F_3$ is less than a maximum value $F_{3max}$ of the order of 20 daN, and this in order to avoid the bowl 3 being applied against the support 5 without the pressurization of the air bearing of the turbine allowing detachment of the bowl and the rotor. In effect, there is a risk that the effort $F_3$ pushes the rotor 11 towards the left in FIGS. 1 to 3, which would have the effect of firmly immobilizing the bowl 3. It is therefore envisaged to obtain an effort $F_3$ whose intensity lies within the non-hatched zone in FIG. 5. In this zone, the variation of the value of the effort $F_3$ with respect to the variation of the value of the air gap e is less than in the hatched zone located above the value $F_{3max}$. In this way, the machining and assembly tolerances do not have too great an influence on the value of the effort $F_3$ or, at least, have less influence than in the aforementioned hatched zone.

In practice, the effort $F_3$ is chosen with a value equal to about 12 daN, this making it possible to determine the value of the air gap e from the curve of FIG. 5. This value may vary over an area $\Delta_e$ visible in FIG. 5 and depending on values $F_{3min}$ and $F_{3max}$. This value depends, in practice, on the inertia of the bowl, therefore on its geometry. It may be different as a function of the types of bowls used.

In order to avoid the accumulation of soiling between the opposite surfaces of the part 42 of the magnet 52, an air flow E is arranged in the air gap between these coupling means.

Figure 6:
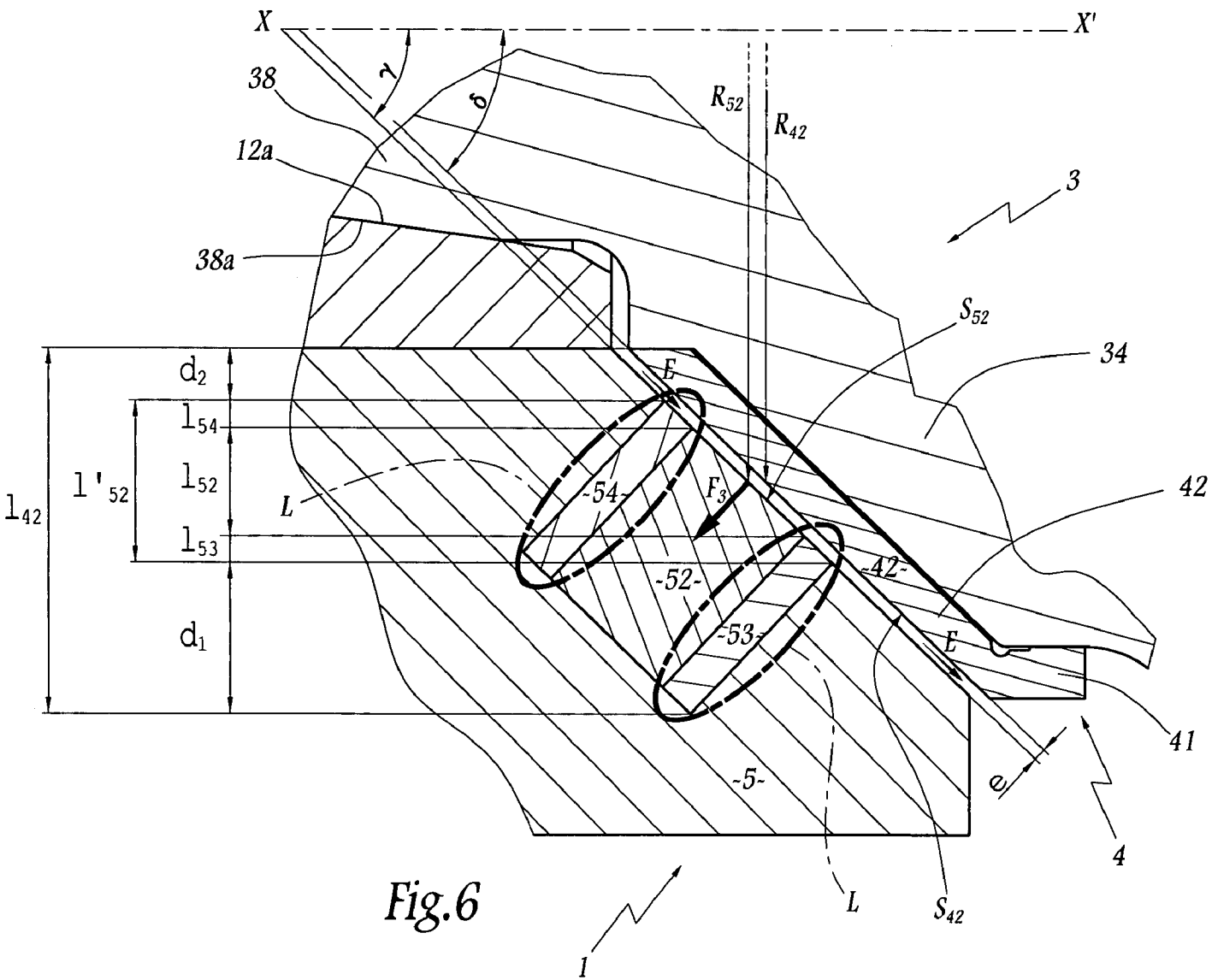
FIG. 6 is a section similar to FIG. 2 for a sprayer and a bowl in accordance with a second form of embodiment of the invention.

In the second form of embodiment of the invention shown in FIG. 6, elements similar to those of the first embodiment bear identical references. The bowl 3 of this embodiment is equipped with a ring 4 force-fitted on the body 34 of this bowl. This ring 4 comprises an annular skirt 41 as well as a truncated part 32 convergent towards the rear of the bowl 3 and centred on the axis of rotation X-X' of this bowl. A support 5 added on a turbine body, of the type of body 15 of the first embodiment, is equipped with a magnet 52 bordered by two washers 53 and 54 made of amagnetic material. Elements 52 to 54 are disposed in the support 5 so that their exposed surfaces are truncated and convergent towards the rear of the turbine, with a semi-vertex angle $\gamma$ equal to the semi-vertex angle $\delta$ of the surface $S_{42}$ of part 42 which faces the elements 52 to 54. $S_{52}$ denotes the exposed surface of the element 52. The surfaces $S_{42}$ and $S_{52}$ are therefore parallel and define therebetween an air gap e of substantially constant thickness, this air gap also being truncated with a semi-vertex angle equal to $\gamma$ and $\delta$. $R_{42}$ and $R_{52}$ respectively denote the mean radii of the surfaces $S_{42}$ and $S_{52}$, these mean radii being substantially equal.

When the bowl 3 is in place on the front end 1 of the turbine, a magnetic coupling effort $F_3$ is exerted, this effort being substantially perpendicular to the surfaces $S_{42}$ and $S_{52}$ in the plane of section of FIG. 6, with the result that it has an axial component parallel to axis X-X'. As for the resultant of the unitary efforts $F_3$ about axis X-X', it is substantially axial.

$l_{42}$ denotes the radial width of the surface 42. $l_{52}$ likewise denotes the radial width of the surface $S_{52}$, and $l_{53}$ and $l_{54}$ the radial widths of the rings 53 and 54. $l'_{52}$ denotes the sum of the widths $l_{52}$, $l_{53}$ and $l_{54}$. As in the first embodiment, the width $l_{42}$ is greater than the width $l'_{52}$, the surface 42 projecting radially outwardly and inwardly with respect to the rings 53 and 54 by an overhang $d_1$ or $d_2$ which is, in practice, of the order of five times the thickness of the air gap e.

The magnetic field lines L reclose through the part 42 of the ring 4, this ensuring an efficient hold of the bowl in position with respect to the end 1 of the turbine.

The bowl 3 is provided with a male part 38 intended to be received in a housing formed by the rotor 11 of the turbine, a connection by adherence taking place under the effect of the effort $F_3$, between the external truncated surface 38*a* of the part 38 and a truncated surface 12*a* defining the housing formed by the rotor 11.

In this embodiment, an air flow E may also be arranged in the air gap e with the particular advantage that the rotation of the bowl induces an effect of "pumping" of the air from the inside to the outside of the air gap e.

What is claimed is:

1. Spraying bowl in combination with a non-rotary part and a rotary drive member for a rotary sprayer spraying coating product, the spraying bowl rotating when said rotary sprayer is in operation, wherein said spraying bowl has a first coupling surface and is equipped with first magnetic coupling means fixed on said spraying bowl for cooperating with second complementary magnetic coupling means, the second magnetic coupling means being fixed on the non-rotary part of said rotary sprayer, the non-rotary part and the second complementary magnetic coupling means being mounted to not rotate when said bowl rotates, said first and second coupling means together constituting means for exerting an at least partially axial force with respect to the axis of rotation of said bowl, said force acting to mechanically firmly couple said bowl with a corresponding second coupling surface of the rotary drive member.

2. The bowl of claim 1, wherein said first coupling means are disposed so that said force is essentially axial.

3. The bowl of claim 1, wherein said bowl comprises a male part, whose external shape is globally truncated, configured for engagement in a central housing of corresponding shape made in said member, said bowl being configured to be connected in rotation with said member by adherence between said male part and said housing, by reason of said axial force.

4. The bowl of claim 1, wherein said bowl defines a globally truncated housing configured to receive a male part of corresponding shape, fast with said drive member, said bowl being configured to be connected in rotation with said member by adherence between said housing and said male part, due to said axial force.

5. The bowl of claim 1, wherein said first magnetic coupling means define an annular or truncated surface delimiting an air gap between said first and second magnetic coupling means, and the radial width of said surface is greater than the total radial width of said second coupling means.

6. The bowl of claim 1, wherein said first magnetic coupling means are formed by an annular element made of magnetic material fitted or screwed around a principal body of said bowl and defining an annular or truncated surface defining an air gap with said second coupling means.

7. Rotary sprayer for spraying coating product, comprising a bowl mounted to rotate when said rotary sprayer is in operation, said bowl having a first coupling surface, a member for driving said bowl in rotation, said member having a second coupling surface complementary to said first coupling surface, and a non-rotary part that does not rotate when said bowl is rotating, wherein said rotary sprayer comprises means for magnetic coupling between said bowl and said non-rotary part of said rotary sprayer, said means exerting an at least partially axial force with respect to the axis of rotation of said bowl, said force inducing a firm mechanical coupling between said first coupling surface of said bowl and said second coupling surface of said member for causing said bowl and said member to rotate as a unit, wherein said means for magnetic coupling includes a magnetic coupling element fixed on said bowl.

8. The sprayer of claim 7, wherein said coupling means are disposed so that said coupling effort is essentially axial.

9. The sprayer of claim 7, wherein said bowl and said member are respectively provided with parts, of complementary shapes, for coupling in rotation by adherence.

10. The sprayer of claim 7, wherein said coupling means comprise at least one magnet disposed in annular manner about the axis of rotation of said bowl and fixed on said non-rotary part, while the coupling means borne by said bowl define an annular or truncated surface delimiting an air gap between said coupling means borne by said bowl and said magnet, and the radial width of said surface is greater than the radial width of said magnet.

11. The sprayer of claim 10, wherein the mean radius of said surface is substantially equal to the mean radius of said magnet.

12. The sprayer of claim 10, wherein said magnet is radially bordered, internally and externally, by two volumes of material which are amagnetic or with low magnetic permeability, while the radial width of said surface is greater than the radial width of said magnet increased by the radial width of said volumes.

13. The sprayer of claim 12, wherein the radial widths of each of said volumes are greater than the air gap between said surface and said magnet, preferably at least three times greater than said air gap, and preferably still of the order of five times said air gap.

14. The sprayer of claim 12, wherein said surface projects radially, inwardly and outwardly, with respect to said magnet and to said volumes, by an overhang at least greater than the air gap between said surface and said magnet, preferably at least three times greater than said air gap, and preferably still of the order of five times said air gap.

15. The sprayer of claim 7, wherein a part of said magnetic coupling means is integrated in an annular support added on the body of said sprayer and extending the body of the sprayer axially.

16. The sprayer of claim 7, wherein the air gap between those parts of said magnetic coupling means respectively fast with said bowl and said non-rotary part is such that said axial effort has an intensity included between 5 and 20 daN.

17. The sprayer of claim 7, wherein said bowl and/or said drive member is provided with at least one clearance for assembly/dismantling.

18. The sprayer of claim 7, wherein an air flow is provided in the air gap between said magnetic coupling means.

19. Installation for spraying coating product, wherein said installation comprises at least one sprayer in accordance with claim 7.

* * * * *